US012186792B2

(12) United States Patent
Lee et al.

(10) Patent No.: US 12,186,792 B2
(45) Date of Patent: Jan. 7, 2025

(54) HOT-STAMPING MOLDING METHOD ENABLING MOLDING OF COMPONENTS HAVING VARIOUS LEVELS OF STRENGTH BY PART THROUGH COOLING CONTROL BY POSITION

(71) Applicant: KOREA INSTITUTE OF INDUSTRIAL TECHNOLOGY, Cheonan-si (KR)

(72) Inventors: Sang Kon Lee, Daegu (KR); In Kyu Lee, Changwon-si (KR); Sung Yun Lee, Daegu (KR); Myeong Sik Jeong, Daegu (KR); Sun Kwang Hwang, Daegu (KR); Dong Yong Park, Daegu (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 214 days.

(21) Appl. No.: 17/787,580

(22) PCT Filed: May 12, 2020

(86) PCT No.: PCT/KR2020/006212
§ 371 (c)(1),
(2) Date: Jun. 20, 2022

(87) PCT Pub. No.: WO2021/125461
PCT Pub. Date: Jun. 24, 2021

(65) Prior Publication Data

US 2022/0410240 A1 Dec. 29, 2022

(30) Foreign Application Priority Data

Dec. 19, 2019 (KR) ..... 10-2019-0170673

(51) Int. Cl.
*B21D 22/02* (2006.01)
*B21D 37/16* (2006.01)
*C21D 1/667* (2006.01)

(52) U.S. Cl.
CPC ..... *B21D 22/022* (2013.01); *B21D 37/16* (2013.01); *C21D 1/667* (2013.01)

(58) Field of Classification Search
CPC ..... B21D 22/02; B21D 22/022; B21D 37/16
See application file for complete search history.

(56) References Cited

U.S. PATENT DOCUMENTS 7,732,734 B2 6/2010 Machrowicz

FOREIGN PATENT DOCUMENTS

JP 2006-192480 A 7/2006
KR 10-1034592 B1 5/2011
(Continued)

OTHER PUBLICATIONS

Machine translation of JP2006192480 (Year: 2024).*
International Search Report mailed Sep. 3, 2020 for PCT/KR2020/006212.

*Primary Examiner* — Teresa M Ekiert
(74) *Attorney, Agent, or Firm* — CANTOR COLBURN LLP

(57) ABSTRACT

According to the present disclosure, a hot stamping forming method for forming components having various strength according to parts through cooling control for each position includes: setting a required strength for each product part for a sheet supplied into a multi-point forming mold device to which a plurality of forming modules are coupled; adjusting an arrangement of the plurality of forming modules according to the set required strength; and performing cooling control for each part by controlling an amount of cooling air or mist sprayed to the sheet by the air jet nozzle in order to achieve a required cooling speed for each strength part of the
(Continued)

supplied sheet, wherein components having various shapes are formable with respect to the supplied sheet in a single mold.

2 Claims, 5 Drawing Sheets

(56) References Cited

FOREIGN PATENT DOCUMENTS

| | | | |
|---|---|---|---|
| KR | 10-1042056 | B1 | 6/2011 |
| KR | 10-1461728 | B1 | 11/2014 |
| KR | 10-1606325 | B1 | 3/2016 |
| KR | 10-1916919 | B1 | 1/2019 |

* cited by examiner

HOT-STAMPING MOLDING METHOD ENABLING MOLDING OF COMPONENTS HAVING VARIOUS LEVELS OF STRENGTH BY PART THROUGH COOLING CONTROL BY POSITION

TECHNICAL FIELD

The present disclosure relates to a technology for forming hot stamping components having various shapes through a single mold by applying a multi-point forming technology for controlling a cooling speed and a temperature of a high-temperature forming material through cooling air flow rate control.

BACKGROUND ART

In the related art, a method of increasing a strength of a material by forming a boron steel material heated to 950° C. or higher in a solid stamping mold and rapidly cooling the boron steel material in the mold at the same time is used.

In detail, the strength is increased by rapidly cooling the material through direct contact between the supplied high-temperature material and the mold. Cooling water flows through a cooling fluid passage in the mold, and a method of rapidly cooling the material by using the cooling water is used.

In order to form various components, a hot stamping mold should be manufactured for each component. Accordingly, there is a limitation in that because a structure of the hot stamping mold is complicated and difficult to process, it is very expensive.

In order to overcome the limitation, a technology for forming hot stamping components having various shapes in one mold by applying hot multi-point forming and molding technologies to hot stamping is proposed.

As related literatures disclosing a variable mold or dieless manufacturing technology for forming a supplied sheet to have a three-dimensional curved surface, Korean Patent No. 10-1034592 (May 12, 2011) and Korean Patent No. 10-1042056 (Jun. 16, 2011) may be referred to.

(Patent Literature 1) KR10-1034592 B (Patent Literature 2) KR10-1042056 B

DISCLOSURE

Technical Problem

To solve the problems in the related art, the present disclosure controls a cooling speed and a temperature of a high-temperature forming material through flow rate control of cooling air or mist supplied through an air jet nozzle for air or mist cooling, and controls a strength for each position through cooling control for each position during hot stamping through partial quenching.

Also, the present disclosure provides a method of forming hot stamping components having various shapes through a single mold by applying a multi-point forming technology through the air jet nozzle.

Technical Solution

According to the present disclosure, there is provided a hot stamping forming method for forming components having various strengths according to parts through cooling control, the hot stamping forming method using a multi-point forming mold device to which a plurality of forming modules are coupled, wherein each of the plurality of forming modules includes a punch body that is vertically driven, an air jet nozzle provided in the punch body, and a punch head detachably coupled to the punch body.

The hot stamping forming method includes: setting a required strength for each product part for a sheet supplied into the multi-point forming mold device; adjusting an arrangement of the plurality of forming modules according to the set required strength; and performing cooling control for each part by controlling an amount of cooling air or mist sprayed to the sheet by the air jet nozzle in order to achieve a required cooling speed for each strength part of the supplied sheet, wherein components having various shapes are formable with respect to the supplied sheet in a single mold.

Each of the plurality of air jet nozzles may include a separate flow rate control valve (140) therein, wherein a strength for each position is controlled by performing partial quenching through cooling control for each part during hot stamping by individually controlling the flow rate control valves.

The required cooling speed for each strength part of the supplied sheet may be calculated by using a continuous cooling transformation (CCT) diagram.

The plurality of forming modules may include a pressing forming module in which the punch head is coupled to the punch body and a cooling forming module in which the punch head is removed from the punch body.

The punch head may include a head body having a hemispherical shape and a head protrusion coupled to a lower end of the head body, wherein the punch head is detachably coupled to the punch body through the head protrusion to open or close an outlet of the air jet nozzle.

Advantageous Effects

According to the present disclosure as described above, hot stamping components having various shapes may be formed in one mold by applying hot multi-point forming and molding technologies to hot stamping.

According to the present disclosure, a required shape may be formed through a punch arrangement according to a shape of a product by applying a multi-point forming technology through an air jet nozzle for refrigerant air or mist cooling to the inside.

A forming module having no forming punch from among a plurality of forming modules including air jet nozzles is used as a forced cooling nozzle, to rapidly cool an existing high-temperature steel sheet material and increase a strength.

Also, because a cooling speed and a temperature of a high-temperature forming material may be controlled through refrigerant cooling airflow rate control, and cooling control may be performed, various strengths that are mechanical properties are implemented in one hot stamping component by controlling a strength for each position by performing partial quenching through cooling control for each part during hot stamping.

According to the present disclosure, because only minimum forming modules required to form a product are arranged for pressing and the remaining forming modules are used as cooling modules, various curved surfaces may be formed through vertical position control of a plurality of punch heads of the pressing forming modules and uniform or local cooling may be performed through a plurality of air jet nozzles provided in the cooling forming modules, thereby continuously performing forming and cooling processes.

BEST MODE

Figure 1:
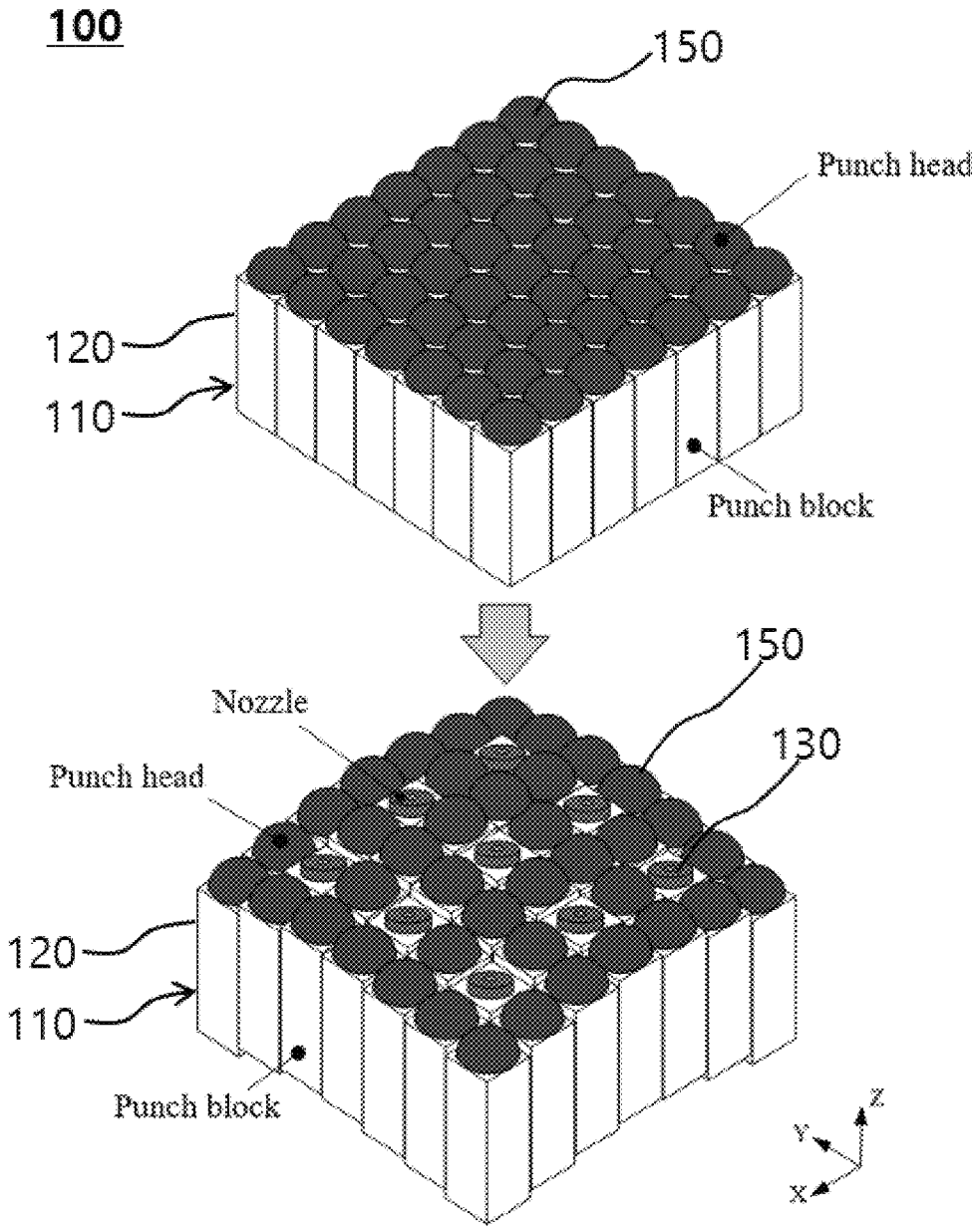
FIG. 1 illustrates a process of performing cooling control for each position for a supplied sheet through a plurality of forming modules having a structure in which a cooling nozzle and a forming nozzle are integrated, according to an embodiment of the present disclosure.

Hereinafter, embodiments of the present disclosure will be described in more detail with reference to the drawings. The present disclosure may, however, be embodied in many different forms and should not be construed as being limited to the embodiments set forth herein; rather, these embodiments are provided so that this disclosure will be thorough and complete, and will fully convey the concept of the present disclosure to one of ordinary skill in the art. In the drawings, the same reference numerals denote the same elements.

In adding reference numerals to elements of each drawing, it should be noted that the same elements are denoted by the same reference numerals as much as possible even when they are shown on different drawings. Also, in describing the present disclosure, detailed descriptions of related well-known functions or configurations that may blur the points of the present disclosure are omitted.

Hereinafter, a structure and a function of a hot multi-point forming mold device according to an embodiment of the present disclosure will be described with reference to FIGS. 1 and 2.

A hot multi-point forming mold device 100 according to the present disclosure includes a plurality of forming modules 110 each independently driven and a mold 150 to which the plurality of forming modules 110 are coupled. The mold 150 includes an upper mold and a lower mold located under the upper mold to be spaced apart from the upper mold.

The plurality of forming modules 110 may be arranged adjacent to one another in vertical and horizontal directions on an inner surface of the upper mold or the lower mold.

The plurality of forming modules 110 of the hot multi-point forming mold device 100 are symmetrically arranged on upper and lower portions. In detail, the plurality of forming modules 110 are arranged on the upper and lower molds in a 7×7 array.

Each of the plurality of forming modules 110 may have a substantially rectangular parallelepiped shape.

Each of the plurality of forming modules 110 includes a punch body 120 that is vertically driven, an air jet nozzle 130 provided in the punch body 120, a flow rate control valve 140 located in the air jet nozzle 120 and configured to control a flow rate of supplied cooling air or mist, and a punch head 150 detachably coupled to the punch body 120.

The punch head 150 includes a head body 152 having a hemispherical shape, and a head protrusion 154 coupled to a lower end of the head body 152.

According to the present disclosure, a boron steel sheet supplied into the hot multi-point forming mold device 100 may be formed to have various curved surfaces through vertical position control of the plurality of punch main bodies 120 located over and under the boron steel sheet.

Also, forming and cooling processes are continuously performed on the boron steel sheet placed on the plurality of forming modules 110 through the air jet nozzle 130 integrated in the punch body 120.

That is, because the punch head 150 of the forming module 110 of the present disclosure is detachably coupled to an end of the punch body 120, the plurality of forming modules 110 may exist in a state where the punch head 150 is coupled to the punch body 120 or in a state where the punch head 150 is removed from the punch body 120.

Accordingly, the plurality of forming modules 110 may include a pressing forming module in which the punch head 150 is coupled to the punch body 120 and a cooling forming module in which the punch head 150 is removed from the punch body 120.

The plurality of forming modules 110 of the hot multi-point forming mold device 100 are symmetrically arranged on upper and lower portions. In detail, it is seen that the pressing forming modules existing in a state where the punch head 150 is coupled to the punch body 120 are arranged substantially along an edge of the hot multi-point forming mold device 100 and the pressing forming modules existing in a state where the punch head 150 is removed from the punch body 120 are arranged inside the pressing forming modules.

In this state, a process of forming a curved surface of the boron steel sheet supplied into the hot multi-point forming mold device 100 is as follows. Heights of the punch heads 150 that press the boron steel sheet are different by independently driving each of the plurality of pressing forming modules arranged on the upper and lower portions along the edge of the hot multi-point forming mold device 100. Accordingly, a curved surface of the supplied boron steel sheet may be formed. Also, an aluminum sheet is cooled by independently driving each of the plurality of cooling forming modules That is, cooling air or mist is supplied to the boron steel sheet through the air jet nozzles 130 located in the punch bodies 120 of the cooling forming modules at the same time as forming.

While the boron steel sheet is directly pressed in a hot state through the forming modules 110 to which the punch heads 150 are coupled, cooling air or mist is supplied at high pressure through the air jet nozzles 130 provided in the forming modules 110 from which the punch heads 150 are removed. Accordingly, various curved surfaces may be formed on the supplied boron steel sheet, and at the same time, uniform or local cooling may be performed.

Figure 2:
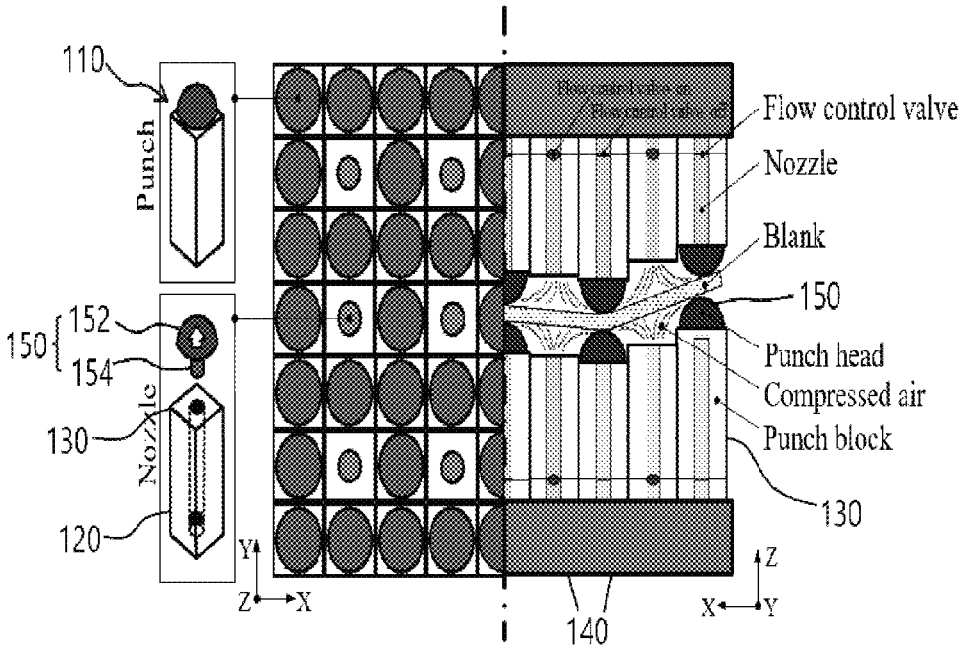
FIG. 2 is a view illustrating an overall structure of a hot multi-point forming mold device including forming modules in which a cooling nozzle and a forming module are integrated, according to an embodiment of the present disclosure.
Figure 3:
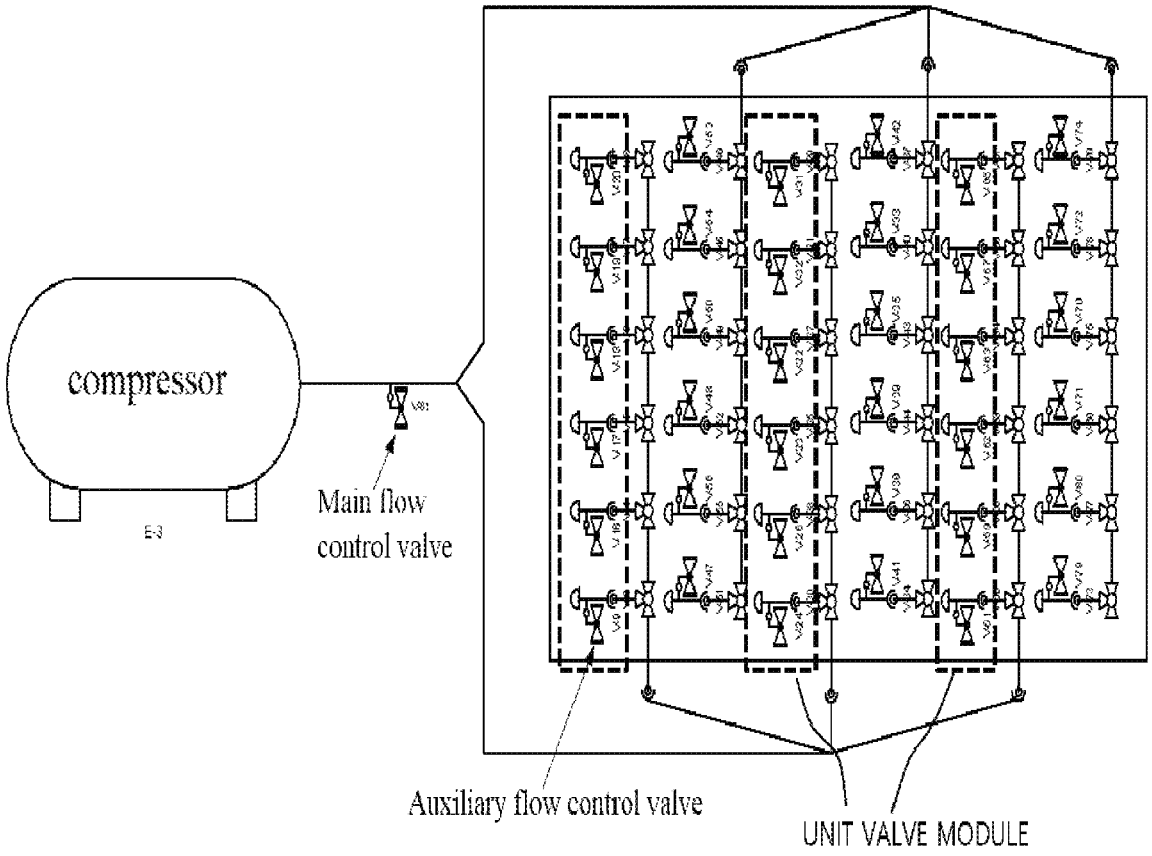
FIG. 3 illustrates a relationship of organically controlling flow rate control valves located in cooling nozzles of a plurality of forming modules.

Referring to FIGS. 2 and 3, each of the plurality of air jet nozzles 130 may include a separate flow rate control valve 140 therein. Actually, in a state where the flow rate control valve 140 is located outside the punch body 120 and the flow rate control valve 140 and the air jet nozzle 130 are connected to each other through a tube, air for cooling control may be supplied to the air jet nozzle 130 in the punch body 120 through the tube.

The flow rate control valves 140 are grouped into unit valve modules, and the valve modules are interoperated with a main flow control valve. In the unit valve modules, portions of providing flow input/output may be alternately arranged vertically. For example, odd-numbered unit valve module groups and even-numbered unit valve module groups may be interoperated with the main flow control valve while having different flow paths. The main flow control valve is coupled to a compressor.

According to the present disclosure, because a cooling speed and a temperature of a high-temperature forming material may be controlled through refrigerant cooling air flow rate control, and cooling control may be performed, a strength for each position is controlled by performing partial quenching through cooling control for each position during hot stamping.

Figure 4:
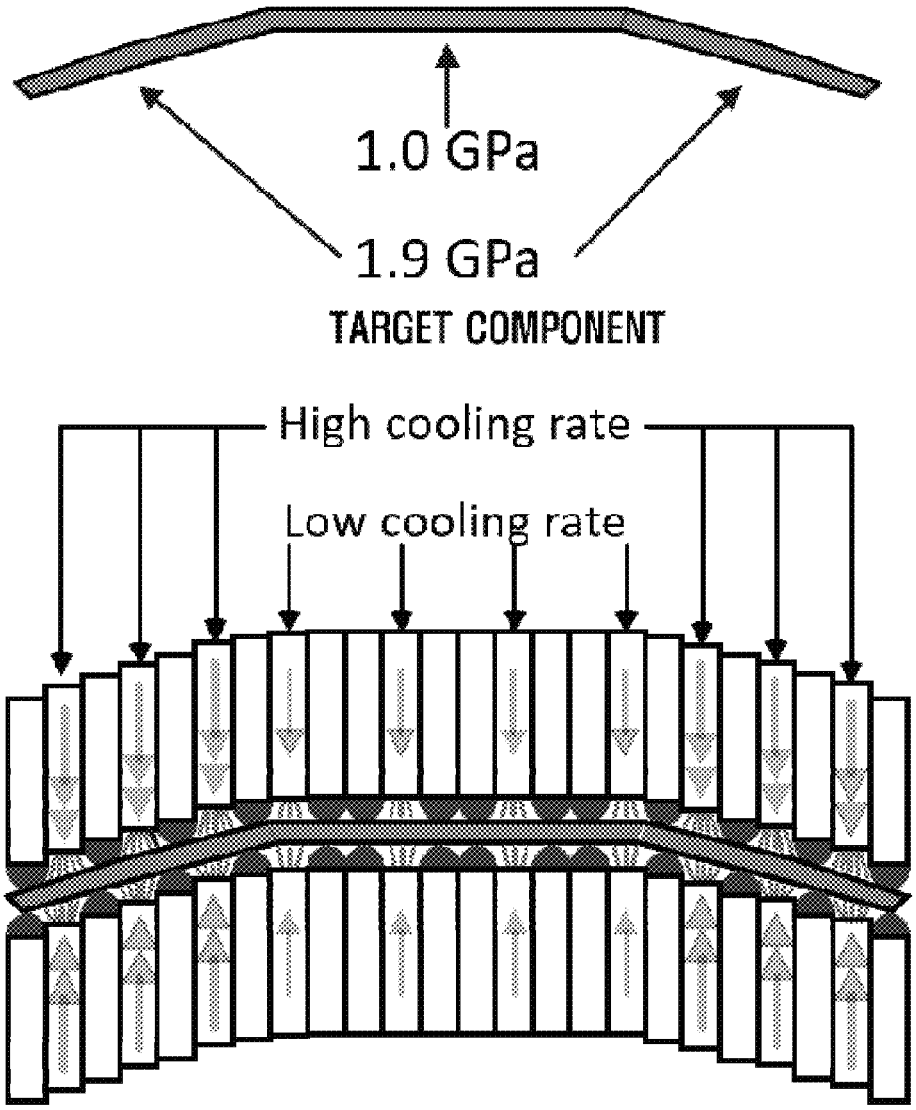
FIG. 4 illustrates a process of controlling a strength for each position by performing partial quenching through cooling control for each position through refrigerant cooling air flow rate control on a supplied sheet.

Referring to FIG. 4, a supplied boron steel sheet is deformed by making heights of punch heads that press the boron steel sheet different from one another by independently driving each of a plurality of pressing forming modules. In detail, an edge portion that is to maintain relatively high strength is bent downward compared to a central portion that is to maintain relatively low strength. In this state, quenching is performed at high speed by setting a flow rate of a refrigerant through a flow rate control valve of a forming module located on the edge portion to be higher than a flow rate of a refrigerant through a flow rate control valve of a forming module located on the central portion. As such, partial quenching is performed by setting a cooling speed differently for each part of the supplied boron steel sheet.

That is, as shown in FIG. 4, a central portion of a target component is set to have a strength of 1.0 GPa and an edge portion of the target component is set to have a strength of 1.9 GPa.

A hot stamping forming method using a hot multi-point forming mold device according to the present disclosure will be described.

First, a required strength for each product part for a sheet supplied into the hot multi-point forming mold device is set. That is, a set strength of a central portion of a supplied target component is 1.0 GPa and a set strength of an edge portion of the target component is 1.9 GPa.

An arrangement of the plurality of forming modules is adjusted according to the set required strengths. That is, a curved surface is formed on a boron steel sheet by adjusting vertical heights of a plurality of punch heads by operating pressing forming modules located over and under the boron steel sheet.

As described above, in a state where the curved surface is formed on the boron steel sheet, cooling control for each part is performed by adjusting the amount of cooling air or mist sprayed to the sheet by the air jet nozzle in order to achieve a required cooling speed for each strength part of the supplied sheet.

An adjustment method by which a refrigerant is supplied at a first flow rate through a unit valve module for a plurality of flow rate control valves located on a curved edge portion of the boron steel sheet and a refrigerant is supplied at a second flow rate through a unit valve module for a plurality of flow rate control valves located on a central portion of the boron steel sheet may be adopted. In a state where a plurality of unit valve modules are arranged in one direction of the boron steel sheet, the amount of refrigerant supply may be adjusted for each unit valve module.

Figure 5:
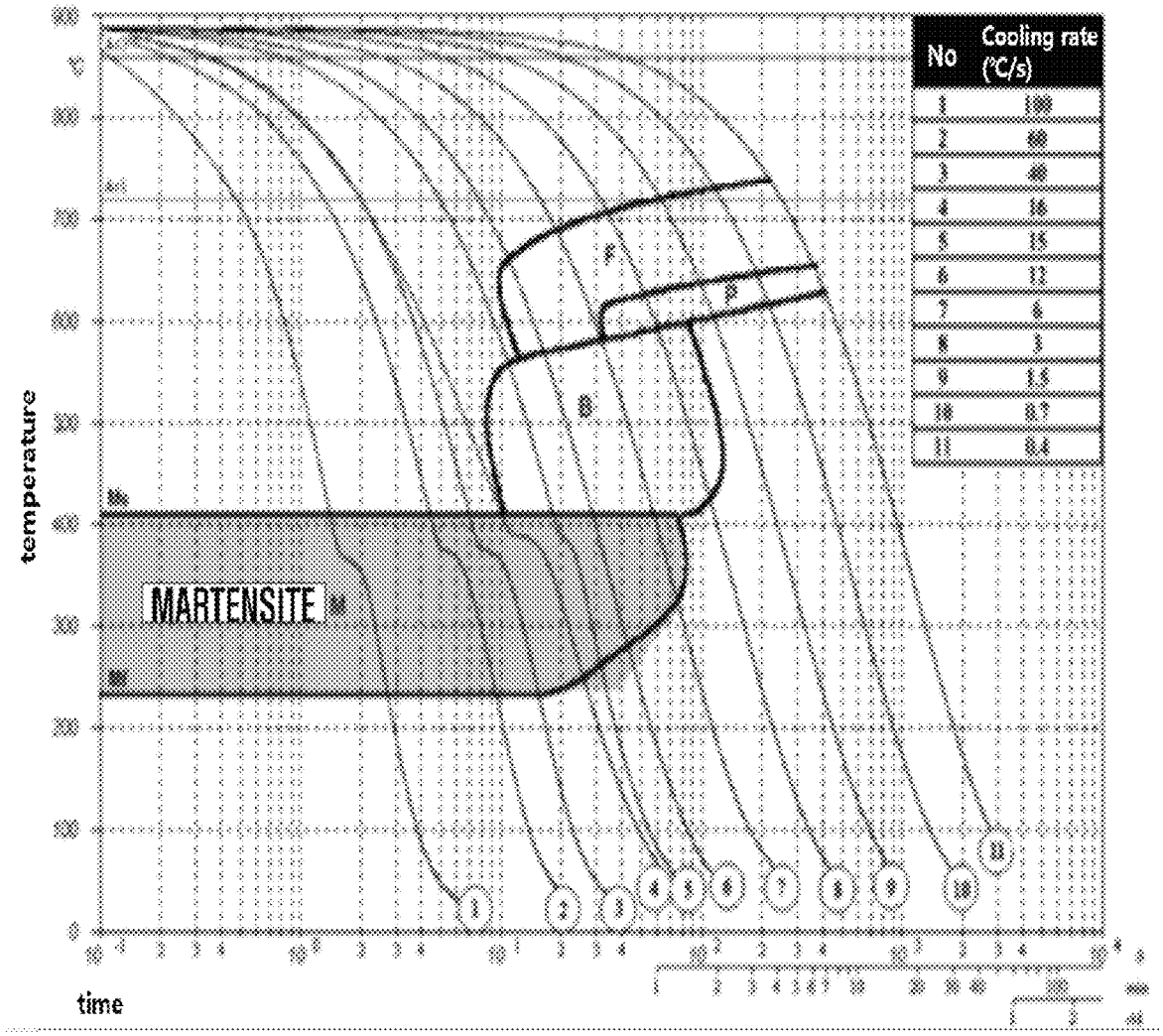
FIG. 5 illustrates a process of calculating a cooling speed for each strength part based on a continuous cooling transformation (CCT) diagram of an applied sheet material.

Referring to FIG. 5, a process of calculating the required cooling speed for each strength part of the supplied sheet may be a calculation method using a continuous cooling transformation (CCT) diagram.

As such, according to the present disclosure, not only a required shape may be formed through a punch arrangement according to a shape of a product by applying a multi-point forming technology through an air jet nozzle through which controllable cooling air or mist is sprayed, but also hot stamping components having various shapes and various strengths may be formed in one mold by applying cooling control hot multi-point forming and molding technologies capable of partial quenching through cooling control to hot stamping.

The above description is merely illustrative of the technical idea of the present disclosure, and one of ordinary skill in the art to which the present disclosure pertains will be able to make various modifications and variations without departing from the essential characteristics of the present disclosure.

Accordingly, the embodiments of the present disclosure should be considered in descriptive sense only and not for purposes of limitation of the scope of the present disclosure. The scope of the present disclosure is defined not by the detailed description of the present disclosure but by the appended claims, and all differences within the scope will be construed as being included in the present disclosure.

The invention claimed is:

1. A hot stamping forming method for forming components having various strengths according to parts of the components through cooling control, the hot stamping forming method using a multi-point forming mold device to which a plurality of forming modules are coupled, wherein each of the plurality of forming modules comprises a punch body that is vertically driven, an air jet nozzle provided in the punch body, and a punch head detachably coupled to the punch body, the hot stamping forming method comprising:

setting a first strength for a central part of a target component and a second strength for an edge part of the target component, wherein the second strength is higher than the first strength, and the target component is supplied into the multi-point forming mold device;

adjusting an arrangement of the plurality of forming modules according to the set required strength; and performing cooling control for each part by controlling an amount of cooling air or mist sprayed to the target component by the air jet nozzle in order to achieve a required cooling speed for each strength part of the supplied target component, wherein the adjusting of the arrangement of the plurality of forming modules includes forming a curved surface on the target component by adjusting vertical heights of the plurality of punch heads by operating pressing forming modules located over and under the target component, wherein each of the plurality of air jet nozzles comprises a flow rate control valve therein, wherein the flow rate control valves are grouped into unit valve modules, the unit valve modules are interoperated with a main flow control valve, in the unit valve modules portions of providing flow input/output are alternately arranged vertically, and wherein the cooling control is performed by setting a flow rate of a refrigerant through the flow rate control valve located on the edge part to be higher than a flow rate of a refrigerant through the flow rate control valve located on the central part.

2. The hot stamping forming method according to claim 1, wherein the punch head comprises a head body having a hemispherical shape and a head protrusion coupled to a lower end of the head body, wherein the punch head is detachably coupled to the punch body through the head protrusion to open or close an outlet of the air jet nozzle.

* * * * *